US008636144B1

(12) United States Patent
Lawery et al.

(10) Patent No.: US 8,636,144 B1
(45) Date of Patent: Jan. 28, 2014

(54) LADDER TOOL TRAY WITH SEPARABLE PAINT BUCKET

(71) Applicants: Mark W. Lawery, Salix, PA (US); Robert A. Low, Duncansville, PA (US)

(72) Inventors: Mark W. Lawery, Salix, PA (US); Robert A. Low, Duncansville, PA (US)

( * ) Notice: Subject to any disclaimer, the term of this patent is extended or adjusted under 35 U.S.C. 154(b) by 0 days.

(21) Appl. No.: 13/754,311

(22) Filed: Jan. 30, 2013

(51) Int. Cl.

| | |
|---|---|
| ***B65D 71/00*** | (2006.01) |
| ***B65D 85/28*** | (2006.01) |
| ***A47F 7/00*** | (2006.01) |
| ***E06C 7/14*** | (2006.01) |

(52) U.S. Cl.
USPC ..... 206/234; 206/373; 182/129; 220/570; 248/210; 248/238

(58) Field of Classification Search
USPC ..... 206/209, 233, 234, 349, 361, 372, 373, 206/379; 182/129; 211/70.6; 248/210, 211, 248/238; 220/570
See application file for complete search history.

(56) References Cited

U.S. PATENT DOCUMENTS

| | | | | |
|---|---|---|---|---|
| 5,370,263 | A | 12/1994 | Brown | |
| 5,505,302 | A * | 4/1996 | Ferley | 206/373 |
| 5,727,649 | A | 3/1998 | Buckley | |
| 5,782,314 | A | 7/1998 | Zeitler | |
| 5,913,380 | A * | 6/1999 | Gugel et al. | 182/129 |
| D427,771 | S | 7/2000 | Trejo | |
| 6,334,509 | B1 * | 1/2002 | Ryszkiewicz | 182/129 |
| 6,382,354 | B2 * | 5/2002 | Ahl et al. | 182/129 |
| 6,401,862 | B1 * | 6/2002 | Caron | 182/129 |
| 6,443,260 | B1 * | 9/2002 | Katz et al. | 206/372 |
| 6,564,941 | B2 | 5/2003 | Hedges | |
| 7,000,876 | B2 | 2/2006 | Searcy | |
| D547,460 | S | 7/2007 | Asham | |
| 7,264,084 | B1 * | 9/2007 | Switzer | 206/373 |
| 2005/0258002 | A1 * | 11/2005 | Sabo | 182/129 |
| 2006/0163003 | A1 * | 7/2006 | Wigstrom, Sr. | 182/129 |
| 2009/0095568 | A1 * | 4/2009 | Webster et al. | 248/210 |

* cited by examiner

*Primary Examiner* — Luan K Bui

(57) ABSTRACT

The present invention features a ladder tool tray with separable paint bucket. The tool tray comprises a first section as a tool organizer and a second section for paint bucket. The second section is removably attached to the first section via securing clasps and a top bracket. The first section comprises a plurality of storage compartments, screw driver holders, drill holders and cleaning tower/clothes hangers. The second section is a paint bucket with integrated hook to hold paint roller above the paint within the paint bucket. Each section has a handle for individual lifting and the handles can be held jointly to carry both sections together.

9 Claims, 5 Drawing Sheets

LADDER TOOL TRAY WITH SEPARABLE PAINT BUCKET

FIELD OF THE INVENTION

The present invention related to a ladder tool tray, and more particularly to a ladder tool tray with separable paint bucket.

BACKGROUND OF THE INVENTION

On some jobs, such as ceiling or a high wall painting, a person will need to frequently climb up and down to change hardware tools and dip paint rollers. Tool trays are well known for most handymen. However, there are not many choices of a ladder tool tray capable of holding paint such that a user can do paint job on ladder directly without multiple climbing efforts. Therefore, there is a need for a ladder tool tray with separable paint bucket.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a ladder tool tray with separable paint bucket. The tool tray comprises a first section as a tool organizer and a second section for paint bucket. The second section is removably attached to the first section via securing clasps and a top bracket. The first section comprises a plurality of storage compartments, screw driver holders, drill holders and cleaning tower/clothes hangers. The second section is a paint bucket with integrated hook to hold paint roller above the paint within the paint bucket. Each section has a handle for individual lifting and the handles can be held jointly to carry both sections together.

DESCRIPTION OF PREFERRED EMBODIMENTS

Figure 1:
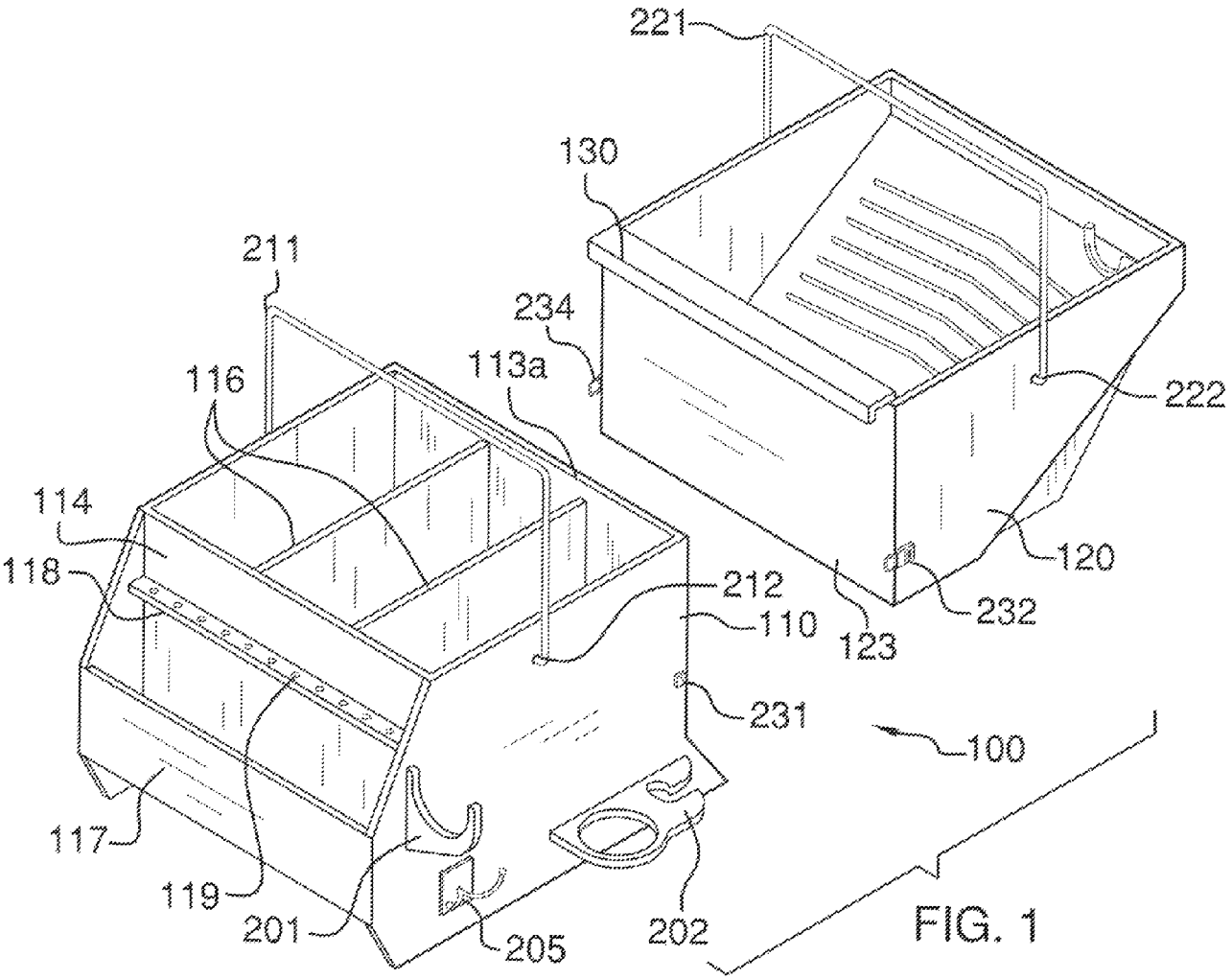
FIG. 1 shows an exploded view of the ladder tool tray.

Following is a list of elements corresponding to a particular element referred to herein:

100 ladder tool tray
110 first sector of the ladder tool tray
111 first side wall of the first section
112 second side wall of the first section
113 third side wall of the first section
113*a* top edge of the third side wall
114 fourth side wall of the first section
115 base panel of the first section
116 dividing walls
117 fifth side wall of the first section
118 screw holder plate
119 holes on the screw holder plate

Figure 2:
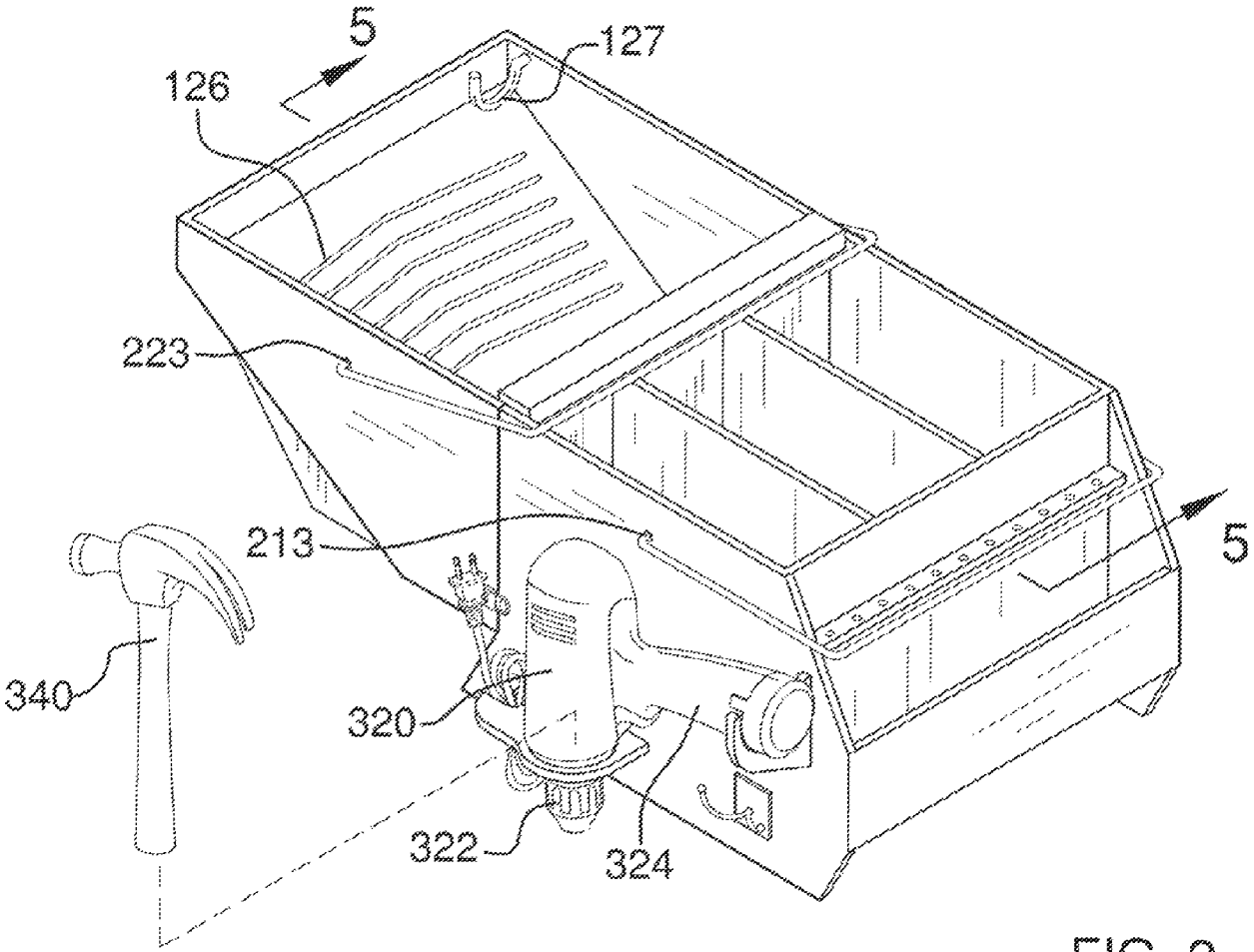
FIG. 2 shows an isometric view of the ladder tool tray.
Figure 3:
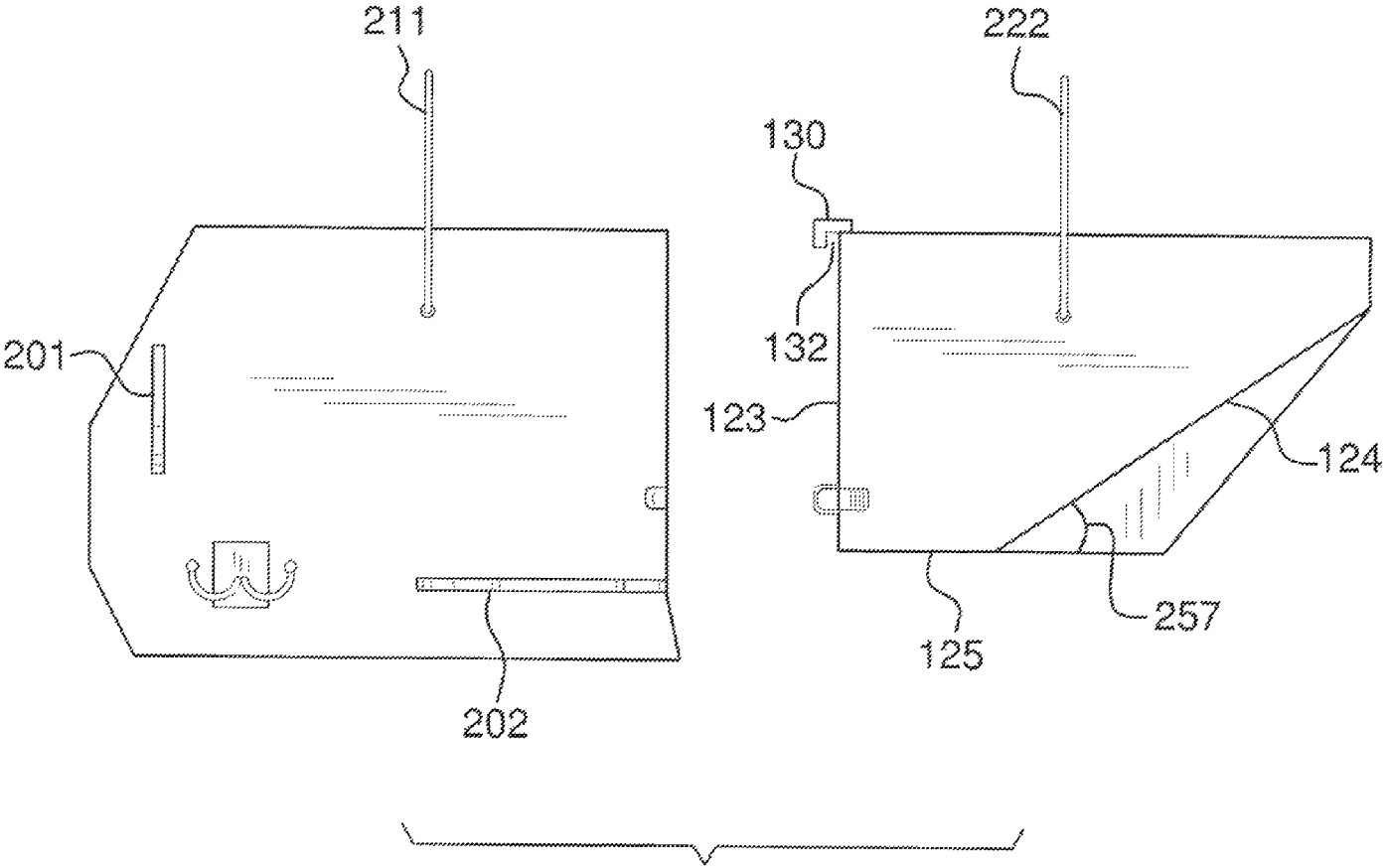
FIG. 3 shows a side view of the ladder tool tray.
Figure 4:
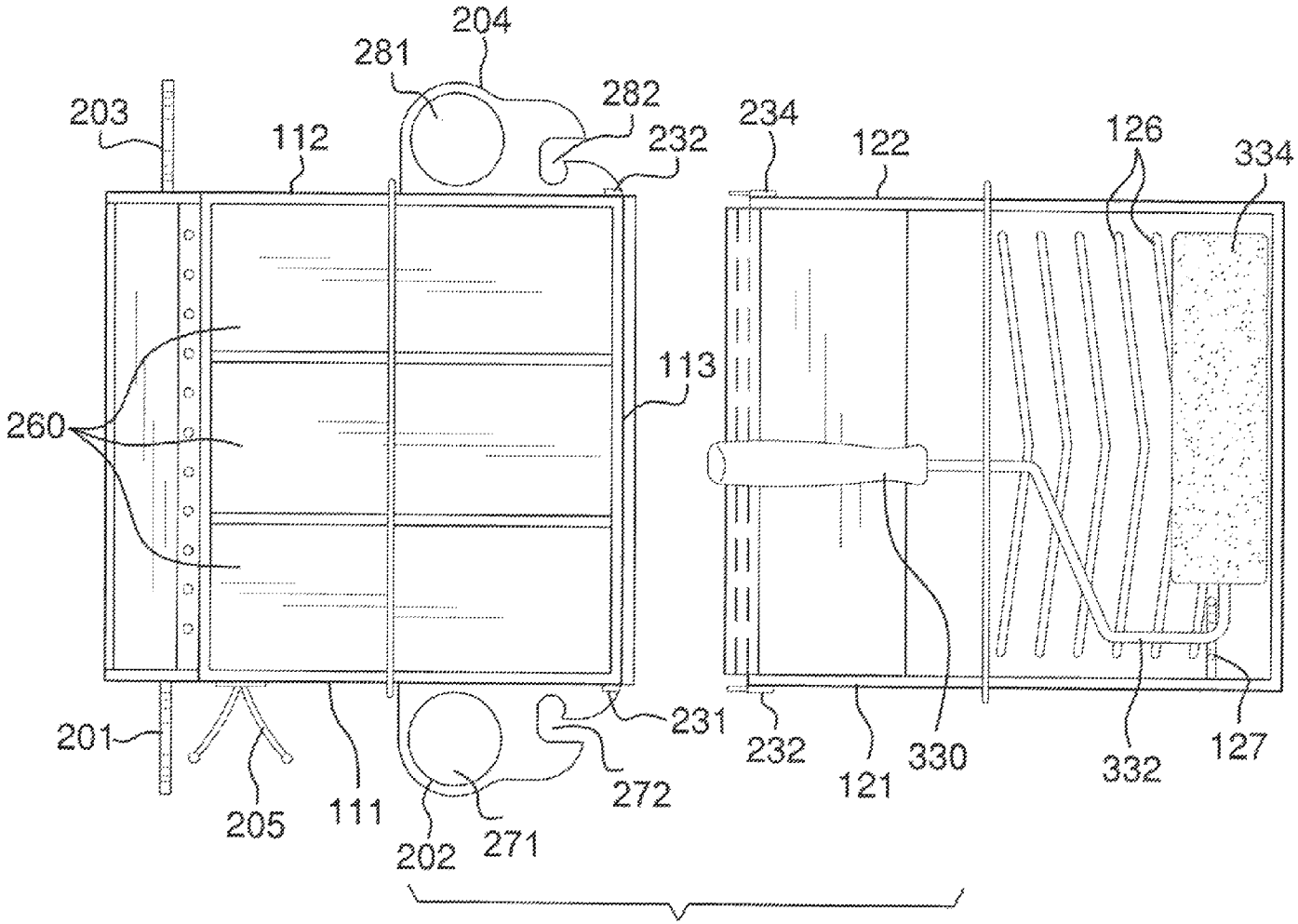
FIG. 4 shows a top view of the ladder tool tray.
Figure 5:
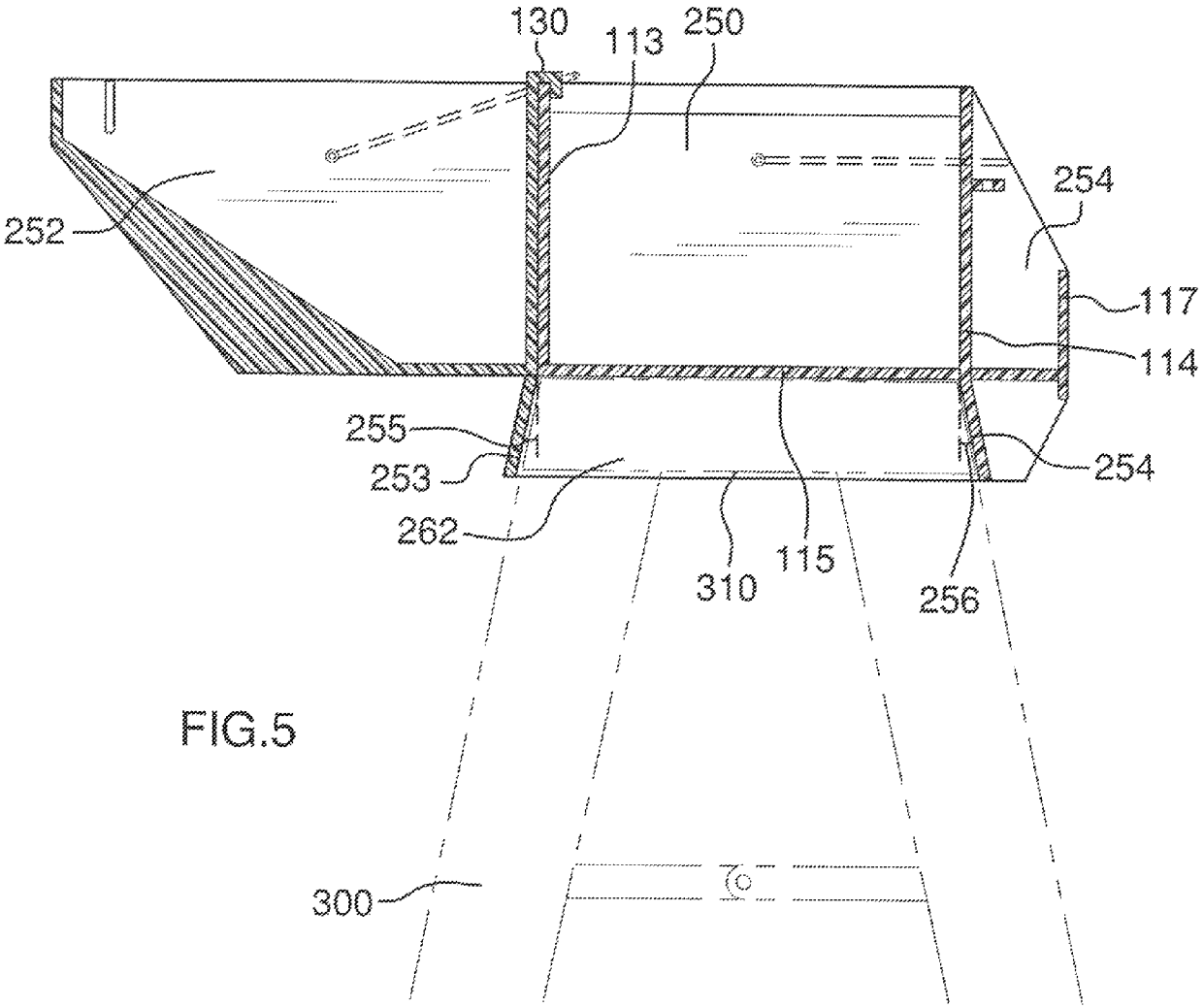
FIG. 5 shows a cross section and in-use view of the ladder tool tray.

120 second section of the ladder tool tray
121 first side wall of the second section
122 second side wall of the second section
123 third side wall of the second section
124 fourth side wall of the second section
125 base bucket wall of the second section
127 paint roller hook
130 top connection bracket
132 groove
201 first support hook
202 first support plate
203 second support hook
204 second support plate
205 towel holder
211 first U-shaped handle
212 first end of the first U-shaped handle
213 second end of the first U-shaped handle
221 second U-shaped handle
222 first end of the second U-shaped handle
223 second end of second U-shaped handle
231 first securing clasp part
232 second securing clasp part
233 third securing clasp part
234 fourth securing clasp part
250 inner pocket
252 paint bucket compartment
253 first lower wall
254 second lower wall
255 first small tilted angle
256 second small tilted angle
257 slope angle
260 inner compartment
262 lower compartment
271 first circular aperture of the first support plate
272 slot of the first support plate
281 second circular aperture of the second support plate
282 slot of the first support plate
300 step ladder
310 top step of the step ladder
320 hand drill
322 drill arm of the hand drill
324 handle arm of the hand drill
330 paint roller
332 connection arm of the paint roller
334 sleeve of the paint roller
340 hammer Referring now to FIG. 1-5, the present invention features a ladder tool tray (100) comprising a first section (110) and a second section (120) with the first section (110) and second section (120) removably jointed together by a connection means.

The first section (110) has a first side wall (111), a second side wall (112), a third wall (113), a fourth side wall (114) and a base panel (115), wherein the first side wall (111) is parallel to the second side wall (112), wherein the third side wall (113) is parallel to the fourth side wall (114), wherein the first side wall is perpendicular to the second side wall (112), wherein an inner pocket (250) is formed by the first, second, third and fourth side walls and the base panel (115), wherein a plurality of dividing walls (116) divide the inner pocket (250) into a plurality of inner compartments (260), wherein the first section further comprises a first U-shaped handle (211) having a first end (212) and a second end (213); wherein the first end (212) is pivotably attached the first side wall (111) and the second end (213) is pivotably attached the second side wall (112).

The first section further comprises a first lower wall (253) and a second lower wall (254), wherein a lower compartment (262) is formed by the first lower wall, second lower wall, the first side wall and the second side wall, wherein the first lower wall (253) is aligned to the third side wall (113) with a first small tilted angle (255), wherein the second lower wall (254) is aligned to the fourth side wall (113) with a second small tilted angle (256), wherein the lower compartment (262) is configured to snugly receive a top step (310) of a step ladder (300), wherein the top step (310) has flat surface.

The second section (120) is functioned as a paint bucket, wherein the second section has a first bucket wall (121), a second bucket wall (122), a third bucket wall (123), a fourth bucket wall (124) and a base bucket wall (125), wherein a paint bucket compartment (252) is formed by the first, second, third and fourth bucket walls and the base bucket wall (125), wherein the fourth bucket (124) wall crosses to the base bucket wall (125) with a slope angle (257) such that the bucket compartment (252) has a trapezoidal shape with a smaller base from side view; wherein the second section further comprises a second U-shaped handle (221) having a first end (222) and a second end (223); wherein the first end (222) is pivotably attached the first bucket wall (121) and the second end (223) is pivotably attached the second bucket wall (122); wherein a plurality of ridges (126) are disposed on the fourth bucket wall (124), wherein the ridges (126) are functioned to roll off excessive paint from a sleeve (334) of a paint roller (330) after the sleeve is dipped with paint; wherein the second section (120) further comprises a paint roller hook (127) disposed on the first bucket wall (121) within the paint bucket compartment (252), wherein the paint roller hook (127) functions to hold a connection arm (332) of the paint roller (330) securely in position and thus prevent the paint roller (330) from accidently submerging within the paint bucket. The paint roller is well known to one of ordinary art in the field.

In some embodiments, the connection means comprises a first securing clasp part (231) disposed on the first side wall (111) adjacent to the third side wall (113), a second securing clasp part (232) disposed on the first bucket wall (121) adjacent to the third bucket wall (123), a third securing clasp part (233) disposed on the second side wall (112) adjacent to the third side wall (113), a fourth securing clasp part (234) disposed on the second bucket wall (122) adjacent to the third bucket wall (123), wherein the third securing clasp part (233) is removably engaged to the first securing clasp part (231) and the fourth securing clasp part (234) is removably engaged to the second securing clasp part (232).

In some embodiments, the connection means further comprises a top connection bracket (130) disposed on the third bucket wall (123), wherein the top connection bracket (130) comprises a groove (132) configured to snugly receive a top edge (113*a*) of the third side wall (113) of the first section (110).

In some embodiments, the first section (110) further comprises a fifth side wall (117) disposed in front of the fourth wide wall (114), wherein a side compartment (254) is formed by the first side wall (111), second side wall (112), the fourth side wall (114), the fifth side wall (117) and the base panel (115), wherein the fifth side wall (117) is lower than the fourth wall (114), wherein the side compartment (254) has a trapezoidal profile in side view.

In some embodiments, a screw holder plate (118) is disposed on the fourth side wall facing the fifth side wall (117), wherein the screw holder plate (118) has a plurality of holes (119) disposed on the screw holder plate, wherein the holes (119) are functioned to hold screw drivers.

In some embodiments, the first section (110) further comprises a tower holder (205) disposed on the first side wall (111), wherein the towel holder (205) is a single hook, double hook or triple-hook piece.

In some embodiments, the first section (110) further comprises a first support hook (201) and a first support plate (202), wherein the first support hook (201) is both disposed on the first side wall (111) adjacent to the third side wall (113), wherein the first support plate (202) is disposed on the first side wall (111) adjacent to the fourth side wall (114) and in a position closer to the base panel (115) than the first support hook (201), wherein the first support hook (201) is perpendicular to the base panel (115) and the first support plate (202) is parallel to the base panel (115), wherein the first support plate (202) comprises a first circular aperture (271) and a slot (272), wherein the first circular aperture (271) is configured to hold a hammer (340) with the hammer (340) sliding into the slot or configured to jointly hold a hand drill (320) with the first support hook (201), wherein the handle drill (320) comprises a drill arm (322) and a handle arm (324), wherein the drill arm (322) rests on the first support plate (202) through the first circular aperture (212) and the handle arm (324) is supported by the first support hook (201). The hand drill is a powered drill or a cordless drill. In some embodiments, the hand drill has a power connection cord (360) with the first slot (272) configured to hold the power connection cord.

In some embodiments, the first section (110) further comprises a second support hook (203) and a second support plate (204), wherein the second support hook (203) is both disposed on the second side wall (112) adjacent to the third side wall (113), wherein the second support plate (204) is disposed on the second side wall (112) adjacent to the fourth side wall (114) and in a position closer to the base panel (115) than the second support hook (203), wherein the second support hook (203) is perpendicular to the base panel (115) and the second support plate (204) is parallel to the base panel (115), wherein the second support plate (204) comprises a second circular aperture (281) and a second slot (282), wherein the second circular aperture (281) and the second support hook (203) are configured to jointly hold the hand drill (320). The second support hook (203) and the second support plate (204) are functioned similarly to the first support hook (201) and the first support plate (202).

The disclosures of the following U.S. Patents are incorporated in their entirety by reference herein: U.S. Pat. No. 5,727,649, U.S. Pat. No. 5,782,314, U.S. Pat. No. 6,564,941, U.S. Pat. No. 7,000,876, U.S. Pat. No. D547,460 and U.S. Pat. No. 5,370,263.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A ladder tool tray (100) with separable paint bucket, wherein the tray comprises:

(a) a first section (110) having a first side wall (111), a second side wall (112), a third wall (113), a fourth side wall (114) and a base panel (115), wherein the first side wall (111) is parallel to the second side wall (112), wherein the third side wall (113) is parallel to the fourth side wall (114), wherein the third side wall is perpendicular to the second side wall (112), wherein an inner pocket (250) is formed by the first, second, third and fourth side walls and the base panel (115), wherein a plurality of dividing walls (116) divide the inner pocket (250) into a plurality of inner compartments (260), wherein the first section further comprises a first U-shaped handle (211) having a first end (212) and a second end (213); wherein the first end (212) is pivotably attached the first side wall (111) and the second end (213) is pivotably attached the second side wall (112);

wherein the first section further comprises a first lower wall (253) and a second lower wall (254), wherein a lower compartment (262) is formed by the first lower wall, second lower wall, the first side wall and the second side wall, wherein the first lower wall (253) is aligned to the third side wall (113) with a first small tilted angle (255), wherein the second lower wall (254) is aligned to the fourth side wall (113) with a second small tilted angle (256), wherein the lower compartment (262) is configured to snugly receive a top step (310) of a step ladder (300), wherein the top step (310) has flat surface;

(b) a second section (120) functioning as a paint bucket, wherein the second section has a first bucket wall (121), a second bucket wall (122), a third bucket wall (123), a fourth bucket wall (124) and a base bucket wall (125), wherein a paint bucket compartment (252) is formed by the first, second, third and fourth bucket walls and the base bucket wall (125), wherein the fourth bucket (124) wall crosses to the base bucket wall (125) with a slope angle (257) such that the bucket compartment (252) has a trapezoidal shape with a smaller base from side view;

wherein the second section further comprises a second U-shaped handle (221) having a first end (222) and a second end (223); wherein the first end (222) is pivotably attached the first bucket wall (121) and the second end (223) is pivotably attached the second bucket wall (122); wherein a plurality of ridges (126) are disposed on the fourth bucket wall (124), wherein the ridges (126) are functioned to roll off excessive paint from a sleeve (334) of a paint roller (330) after the sleeve is dipped with paint; wherein the second section (120) further comprises a paint roller hook (127) disposed on the first bucket wall (121) within the paint bucket compartment (252), wherein the paint roller hook (127) functions to hold a connection arm (332) of the paint roller (330); and wherein the first section (110) and second section (120) are removably jointed together by a connection means.

2. The ladder tool tray (100) of claim 1, wherein the connection means comprises a first securing clasp part (231) disposed on the first side wall (111) adjacent to the third side wall (113), a second securing clasp part (232) disposed on the first bucket wall (121) adjacent to the third bucket wall (123), a third securing clasp part (233) disposed on the second side wall (112) adjacent to the third side wall (113), a fourth securing clasp part (234) disposed on the second bucket wall (122) adjacent to the third bucket wall (123), wherein the third securing clasp part (233) is removably engaged to the first securing clasp part (231) and the fourth securing clasp part (234) is removably engaged to the second securing clasp part (232).

3. The ladder tool tray (100) of claim 2, wherein the connection means further comprises a top connection bracket (130) disposed on the third bucket wall (123), wherein the top connection bracket (130) comprises a groove (132) configured to snugly receive a top edge (113*a*) of the third side wall (113) of the first section (110).

4. The ladder tool tray (100) of claim 1, wherein the first section (110) further comprises a fifth side wall (117) disposed in front of the fourth wide wall (114), wherein a side compartment (254) is formed by the first side wall (111), second side wall (112), the fourth side wall (114), the fifth side wall (117) and the base panel (115), wherein the fifth side wall (117) is lower than the fourth wall (114), wherein the side compartment (254) has a trapezoidal profile in side view.

5. The ladder tool tray (100) of claim 4, wherein a screw holder plate (118) is disposed on the fourth side wall facing the fifth side wall (117), wherein the screw holder plate (118) has a plurality of holes (119) disposed on the screw holder plate, wherein the holes (119) are functioned to hold screw drivers.

6. The ladder tool tray (100) of claim 1, wherein the first section (110) further comprises a tower holder (205) disposed on the first side wall (111), wherein the towel holder (205) is a single hook, double hook or triple-hook piece.

7. The ladder tool tray (100) of claim 1, wherein the first section (110) further comprises a first support hook (201) and a first support plate (202), wherein the first support hook (201) is disposed on the first side wall (111) adjacent to the fourth side wall (114), wherein the first support plate (202) is disposed on the first side wall (111) adjacent to the third side wall (113) and in a position closer to the base panel (115) than the first support hook (201), wherein the first support hook (201) is perpendicular to the base panel (115) and the first support plate (202) is parallel to the base panel (115), wherein the first support plate (202) comprises a first circular aperture (271) and a slot (272), wherein the first circular aperture (271) is configured to hold a hammer (340) with the hammer (340) sliding into the slot or configured to jointly hold a hand drill (320) with the first support hook (201), wherein the handle drill (320) comprises a drill arm (322) and a handle arm (324), wherein the drill arm (322) rests on the first support plate (202) through the first circular aperture (212) and the handle arm (324) is supported by the first support hook (201).

8. The ladder tool tray (100) of claim 7, wherein hand drill (320) further comprises a power connection cord (360), wherein the first slot (214) is configured to hold the power connection cord (360).

9. The ladder tool tray (100) of claim 1, wherein the first section (110) further comprises a second support hook (203) and a second support plate (204), wherein the second support hook (203) is disposed on the second side wall (112) adjacent to the fourth side wall (114), wherein the second support plate (204) is disposed on the second side wall (112) adjacent to the third side wall (113) and in a position closer to the base panel (115) than the second support hook (203), wherein the second support hook (203) is perpendicular to the base panel (115) and the second support plate (204) is parallel to the base panel (115), wherein the second support plate (204) comprises a second circular aperture (281) and a second slot (282), wherein the second circular aperture (281) and the second support hook (203) are configured to jointly hold the hand drill (320).

* * * * *